United States Patent [19]

Lynn et al.

[11] 4,096,364

[45] Jun. 20, 1978

[54] KEYBOARD SWITCH ASSEMBLY HAVING FLEXIBLE CONTACT LAYER WITH SNAP INITIATOR DOME

[75] Inventors: William Joseph Lynn, Groveland; Richard E. Seeger, Topsfield, both of Mass.

[73] Assignee: Chomerics, Inc., Woburn, Mass.

[21] Appl. No.: 770,519

[22] Filed: Feb. 22, 1977

[51] Int. Cl.[2] ..... H01H 13/70; H01H 1/00

[52] U.S. Cl. ..... 200/5 A; 200/159 B; 200/275

[58] Field of Search ..... 200/5 R, 5 A, 67 DA, 200/67 DB, 86 R, 159 R, 159 A, 159 B, 275, 302, 264, 340

[56] References Cited

U.S. PATENT DOCUMENTS

| | | | |
|---|---|---|---|
| 3,800,104 | 3/1974 | Lien et al. | 200/5 A |
| 3,860,771 | 1/1975 | Lynn et al. | 200/5 A |
| 3,879,586 | 4/1975 | DuRocher et al. | 200/5 A |
| 3,898,421 | 8/1975 | Suzumura | 200/159 B |
| 3,916,135 | 10/1975 | Holden et al. | 200/159 B X |
| 3,932,722 | 1/1976 | Obata et al. | 200/159 B X |
| 3,941,953 | 3/1976 | Misson et al. | 200/5 A X |
| 3,978,297 | 8/1976 | Lynn et al. | 200/340 X |

*Primary Examiner*—James R. Scott

*Attorney, Agent, or Firm*—Sewall P. Bronstein

[57] ABSTRACT

Keyboards having flexible plastic domes which snap when depressed to provide tactile feel, at least some of said domes formed from a sheet of plastic and having a bar shaped concave snap initiator formed in said dome, and an actuator comprising at least one cross bar for engaging the snap initiator to initiate dome depression in situations in which the actuator used to depress the dome does not effectively produce snapping of the conventional dome because of the shape of the actuator.

10 Claims, 14 Drawing Figures

KEYBOARD SWITCH ASSEMBLY HAVING FLEXIBLE CONTACT LAYER WITH SNAP INITIATOR DOME

BACKGROUND OF THE INVENTION

This invention is directed to keyboards employing snappable plastic domes such as shown in U.S. Pat. No. 3,860,771 and is more particularly directed to a modification of the dome structure in said patent to achieve effective snapping of the dome in cases in which the actuator or button configuration is such that a good clean snap cannot be consistently achieved.

It has been found in practice that in order for a plastic dome of the shape shown in U.S. Pat. No. 3,860,771 to provide consistently good snap when depressed by an actuator portion of a button, the actuator portion should be of a configuration such that a sufficient surface area of the dome is being engaged during depression to effect snap.

In addition, it is also important that the button does not include other surfaces which may engage the dome while it is being depressed because this too will frequently cause poor snapping of the dome.

The present invention provides a solution to the aforementioned difficulties by providing a snap initiator at the top of the dome which will compensate for variations in the shape of the actuator. The snap initiator will in effect act as a portion of the actuator so that the forces caused by button depression are applied across the dome in a manner in achieve consistently good snap.

BRIEF SUMMARY OF THE INVENTION

This invention comprises a keyboard having a plurality of domes which are depressible by buttons having actuator portions, the domes having a snap initiator formed at the top thereof to provide a consistently good snap action. Thus with the invention buttons having a relatively tiny actuator portion, a pair of raised surfaces which act as actuator portions or other shaped actuators can be accomodated by use of domes containing snap initiators and thus expensive modifications in the shape of the buttons can be avoided by the use of the snap initiator of this invention.

In the preferred embodiment the snap initiator is hollow and concave with respect to the dome under surface and is preferably bar shaped.

It should also be understood that in certain keyboards, all domes need not contain snap initiators if some of the actuators are shaped such that a good snap may be achieved. For example, in a calculator such as the Hewlett-Packard Company HP-22, only the larger buttons, for example, the numerical buttons are shaped such that snap initiators should be provided to achieve consistently good snap action. Whereas, the remaining smaller buttons of the HP-22 calculator are shaped so that the conventional dome as shown in U.S. Pat. No. 3,860,771 need not be modified.

It should also be understood that the hollow initiators may be stiffened if desired by using a filler, for example, a hard plastic such as epoxy. However, it has been found to date that this has not been necessary.

DETAILED DESCRIPTION OF THE DISCLOSURE

Figure 1:
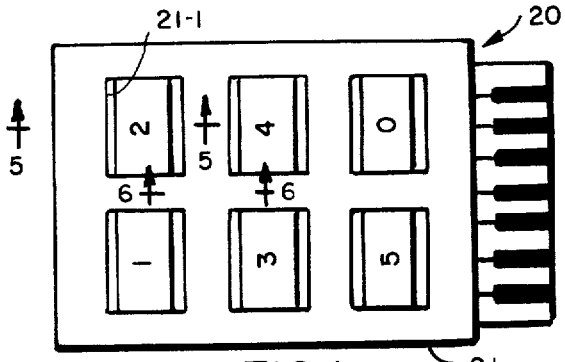
FIG. 1 is a top view of a keyboard according to the invention.
Figure 2:
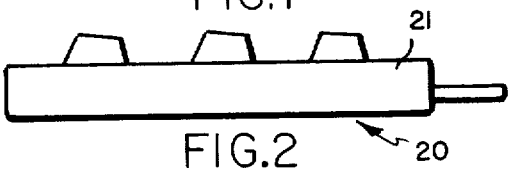
FIG. 2 is a side view of the keyboard of FIG. 1.
Figure 5:
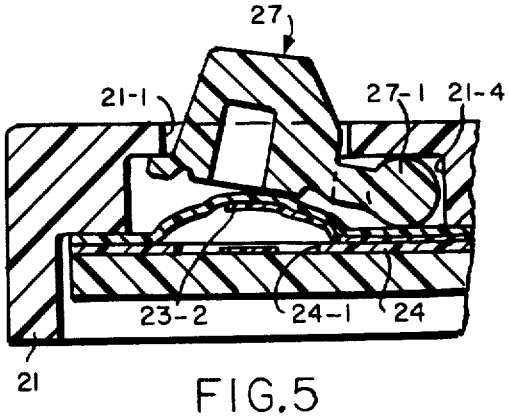
FIG. 5 is a sectional view taken along line 5—5 in FIG. 1.
Figure 4:
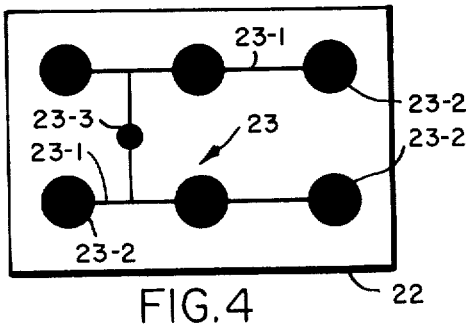
FIG. 4 is a bottom view of the top flexible domed sheet of the invention showing the upper circuit pattern.
Figure 3:
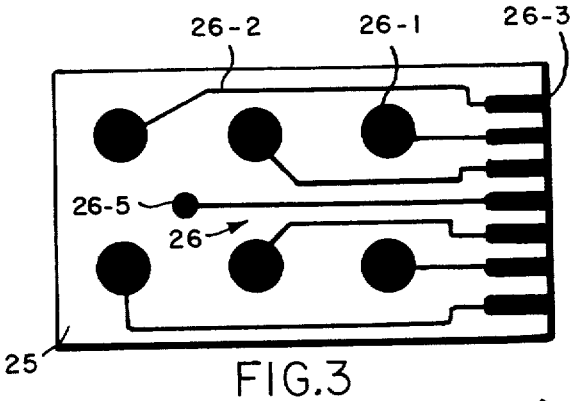
FIG. 3 is a top view of the bottom circuit board and circuit of the keyboard disclosed herein.

Reference should now be had to FIGS. 1 to 14 for a detailed description of the preferred embodiment of the disclosure. A keyboard 20 comprises a frame 21 preferably made of insulative or plastics material such as Lexan having windows 21-1. The keyboard includes an insulator sheet of flexible and resilient plastic 22 preferably of polyester such as Mylar, for example, of 5 mil thickness having depressible and snappable convex domes 22-1 of the configuration as shown in U.S. Pat. No. 3,860,771 and which have been modified to include a snap initiator 22-2. The domes 22-1 are convex with respect to the top of the sheet 22; that is, the portion not supporting the circuit pattern 23.

The sheet 22 also supports the aforementioned circuit pattern 23 which may be conductive plastic ink, etched copper. The circuit pattern includes circuit lines 23-1, depressible contactors 23-2 and a contactor 23-3 for supplying power to the circuit pattern 23.

The contactors 23-2 are supported on the underside of the domes 22-1 and preferably extend into the snap initiators 22-2. Positioned under the sheet 22 is a snap through layer 24 of plastic non-conductive material such as Mylar or other well known non-conductive materials the snap through layer 24 has register openings 24-1 through which the contactors 23-2 may extend to engage portions 26-1 of the underlying circuit pattern 26.

The underlying circuit pattern 26 comprises contacts 26-1, circuit lines 26-2 and terminals 26-3 to which external connections to the keyboard are made. The circuit pattern 26 may be etched copper or conductive plastic ink.

Figure 6:
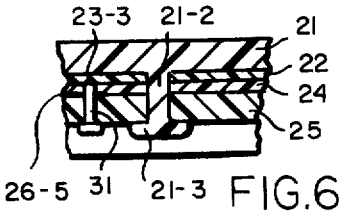
FIG. 6 is a sectional view taken along line 6—6 in FIG. 1 to illustrate the connection of a portion of the upper circuit pattern to the lower circuit pattern by a pin.

Additionally, the circuit pattern 26 includes a contact 26-5 which is coupled to contactor 23-3 through a metal pin 31 (see FIG. 6). The circuit pattern 26 is positioned on an insulator layer 25 for example made of, epoxy or polyester, etc., and the entire keyboard is held together by rods 21-2 extending from the plastic frame which is heated to form heads 21-3. The rods 21-2 may alternatively be threaded and nuts may be used to hold the assembly together.

Buttons 27 are pivotally positioned in the frame. Each of the buttons is made of plastics material such as ABS, Lexan (see FIGS. 5, 10, 11 and 12) and have a pin 27-1 which rotates in frame channels 21-4. The buttons 27 have portions carrying indicia which extend through the windows 21-1 so that the user may depress the button 27.

With the particular button 27 shown there are provided actuator bars 27-2 and 27-3 at the bottom thereof which engage the snap initiator in order to snap the domes 22-1. While the bars themselves are adequately shaped to depress the conventional dome as shown in U.S. Pat. No. 3,860,771, the particular type of button in the HP-22 calculator also has a sloping surface 27-4 which because of its height also applied a force to the conventional dome when it was being depressed. The surface 27-4 in applying a force interferred with the attaining of a good snap since it touched the dome side while the dome was being depressed by the bars 27-2 and 27-3.

In order to overcome the difficulty in attaining consistently good snap, the present invention has provided a bar shaped concave protrusion or initiator 22-2 at the top of the dome so that the bars 27-2 and 27-3 will engage the initiator to produce effective snap while preventing the surface 27-4 from engaging the dome 22-1 to prevent a good snap. The snap initiator 22-2 is preferably at the dome top and is preferably centered with respect to the dome 22-1 although it may be somewhat off center if necessary to accomodate a particularly pecular shaped actuator.

Figure 8:
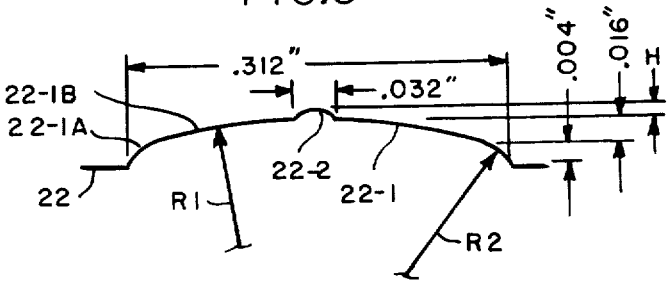
FIG. 8 is a sectional view taken along line 8—8 in FIG. 7.
Figure 7:
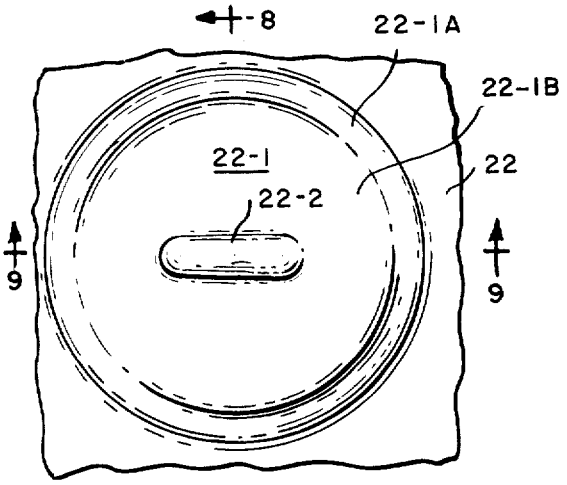
FIG. 7 is a greatly enlarged top view of the dome of the invention.
Figure 9:
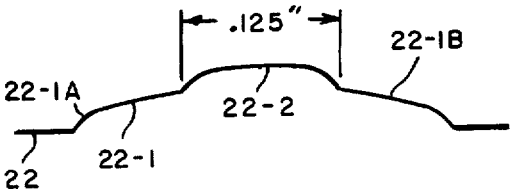
FIG. 9 is a sectional view taken along line 9—9 in FIG. 8.
Figure 10:
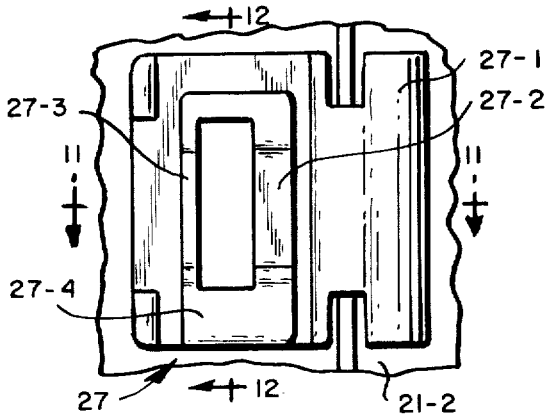
FIG. 10 is a bottom view of the key used in the keyboard of the disclosure.
Figure 12:
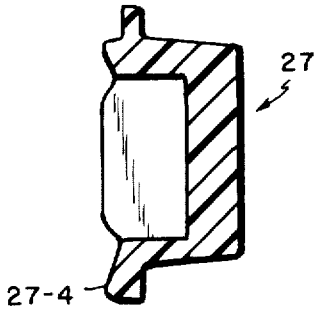
FIG. 12 is a sectional view taken along line 12—12 in FIG. 11.
Figure 11:
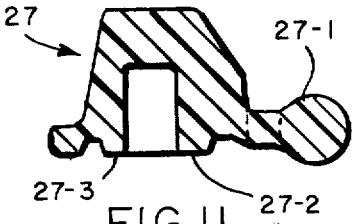
FIG. 11 is a sectional view taken along line 11—11 in FIG. 10.

Reference should now be had to FIGS. 7 to 9 which show the dome 22-1 and initiator 22-2 in more detail to accomodate the button 27 shown in FIGS. 10 to 12. In this figure the dome has an annular opening of 312 mils, a step or pedestal 21-1A is formed with a spherical radius $R_2$ of about 125 mils as observed and has a height of about 4 mils, the dome cap 21-1B is formed with a spherical radius $R_1$ of 500 mils and has a height of 16 mils. The concave protrusion 22-2 has a height H of 10 mils, a width of 32 mils and a length of 125 mils.

It should be understood that these dimensions given are illustrative and not meant to be limiting and will vary obviously depending upon the actuator and the size of the dome.

Figure 13:
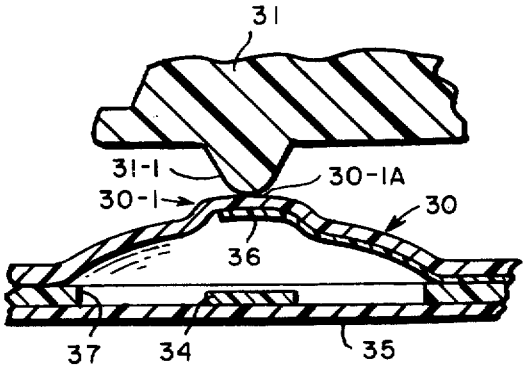
FIG. 13 is a sectional view of another dome embodiment of the invention.
Figure 14:
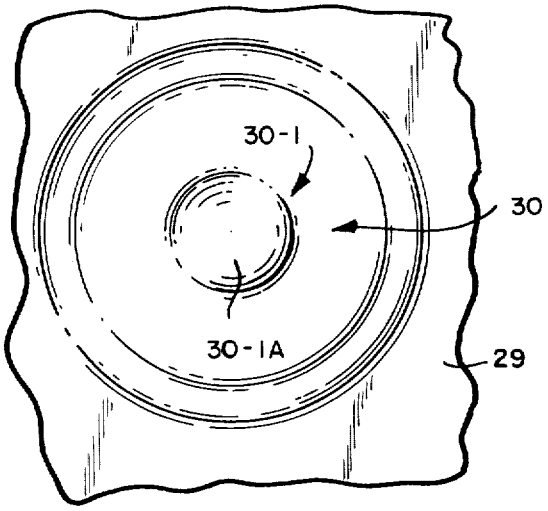
FIG. 14 is a top view of the dome in FIG. 13 without the actuator of FIG. 13.

In FIGS. 13 and 14, there is shown a plastic sheet 29 as aforementioned with a snappable dome 30 which is provided with a cylindrical concave protrusion or initiator 30-1 to accomodate a depressible button 31 having a small contact area actuator 31-1. The actuator 31-1 is used to depress the initiator surface 30-1A.

In cases such as this the actuator 31-1 does not depress the dome top in a manner to consistently produce a good snap since it has a tendency to cause the rolling over of a small portion of the dome 32 prior to causing it to snap.

To overcome this problem a substantially cylindrical initiator 30-1 is provided which is substantially greater in top surface area 30-1A than the tip of the actuator 31-1. The initiator 30-1 will cause the force provided by the actuator 31-1 to be applied over the dome in a manner to effect good snap. For example, with an actuator having a contact surface of a diameter of 60 mils a snap initiator 30-1 of a top 30-1A, diameter of 100 mils and height of 10 mils, may be provided to obtain good snap.

The conventional contact is shown at 34 on the circuit board 35 and the dome 30 supports the conventional contactor 36 as shown which is adhered thereto. A spacer is also shown at 37.

It should also be observed that the snap initiator engages the button to urge it upwardly to prevent the button from being loose in the frame. The dome with initiator, because of the material used, therefore acts as a spring to spring load the button.

We claim:

1. A keyboard assembly comprising an insulator support member, a first circuit pattern supported by said support member means, said first circuit pattern having contactors and circuit lines selectively coupled to said contactors, an insulator material snap through spacer over said support member and first circuit pattern, said spacer having a plurality of openings therethrough each in register with different ones of said contacts, a sheet of flexible and resilient insulator plastic having a plurality of snappable domes formed therein, said domes in register with different ones of said spacer openings, a second circuit pattern adhered to the flexible and resilient sheet, said second circuit pattern having contactors and circuit lines selectively coupled to said contactors, said contactors being supported on the under surface of said domes, at least some of said domes having a snap initiator formed in the dome at the top thereof, said initiator in the shape of a bar having a width less than its length at its base, the bar being concave with respect to the under surface of the dome.

2. The assembly of claim 1 in which the dome comprises a step which supports a curved surface.

3. The assembly of claim 1 in which the sheet is a polyester material.

4. The assembly of claim 2 in which the sheet is a polyester material.

5. The assembly of claim 1 in which the assembly has a plurality of actuators; means for supporting said actuators, a different actuator engaging a different one of said bar shaped snap initiators to depress said respective dome having said bar shaped snap initiator.

6. The assembly of claim 3 in which the assembly has a plurality of actuators, means for supporting said actuators, a different actuator engaging a different one of said bar shaped snap initiators to depress said respective dome having said bar shaped snap initiator.

7. A keyboard assembly comprising a first support having a plurality of windows, a plurality of buttons positioned for motion by said first support, a sheet of flexible and resilient plastic having a plurality of snappable domes, each of said domes being in register with a different one of said buttons, a bar shaped snap initiator formed in at least some of said domes, said bar shaped snap initiator being concave with respect to the surface of said sheet farthest away from said buttons, a contactor supported by the undersurface of each of said domes, an insulator spacer sheet having a plurality of openings, a different opening in register with a different one of said bar shaped initiators, a second insulator support positioned below said spacer, said insulator support supporting a plurality of contacts, at least one contact in register with a different one of said spacer openings, at least some of said buttons having at least one cross bar, each of said some buttons having said cross bar being depressible to cause said cross bar to engage said bar shaped snap initiator in register therewith to cause said dome to snap.

8. The assembly of claim 7 in which at least some of said domes have a step which supports a curved surface.

9. The assembly of claim 8 in which said sheet is of polyester material.

10. The assembly of claim 9 in which said buttons urge said domes against said second insulator support contacts.

* * * * *